US008418609B2

(12) United States Patent
Doppler et al.

(10) Patent No.: US 8,418,609 B2
(45) Date of Patent: Apr. 16, 2013

(54) IMPRESSION ROLLER

(75) Inventors: Alfred Doppler, Biel-Benken (CH); Pierre Rischmann, La Wantzenau (FR)

(73) Assignee: Alfred Doppler, Biel-Benken (CH)

( * ) Notice: Subject to any disclaimer, the term of this patent is extended or adjusted under 35 U.S.C. 154(b) by 289 days.

(21) Appl. No.: 12/741,537

(22) PCT Filed: Nov. 3, 2008

(86) PCT No.: PCT/CH2008/000459

§ 371 (c)(1),
(2), (4) Date: May 5, 2010

(87) PCT Pub. No.: WO2009/059442

PCT Pub. Date: May 14, 2009

(65) Prior Publication Data

US 2010/0263563 A1 Oct. 21, 2010

(30) Foreign Application Priority Data

Nov. 7, 2007 (CH) ..... 1728/07

(51) Int. Cl.
*B41F 9/00* (2006.01)

(52) U.S. Cl.
USPC ..... 101/153; 101/216

(58) Field of Classification Search ..... 101/153
See application file for complete search history.

(56) References Cited

U.S. PATENT DOCUMENTS 3,477,369 A * 11/1969 Coberley et al. ..... 101/153
3,489,082 A 1/1970 Morris
3,905,296 A * 9/1975 Washschynsky et al. ..... 101/348
4,514,781 A * 4/1985 Plasschaert et al. ..... 361/230
4,539,908 A 9/1985 Spengler
4,966,555 A 10/1990 Zagorski (Continued)

FOREIGN PATENT DOCUMENTS

| | | |
|---|---|---|
| DE | 94 19 540 | 1/1995 |
| DE | 203 19 870 | 5/2005 |
| EP | 1 477 310 | 11/2004 |
| WO | WO 98/03049 | 1/1998 |

OTHER PUBLICATIONS

International Search Report issued in PCT/CH2008/000459, mailed Jun. 2, 2009.
German International Preliminary Report on Patentability issued in PCT/CH2008/000459, mailed Apr. 6, 2010.

(Continued)

*Primary Examiner* — Anthony Nguyen
(74) *Attorney, Agent, or Firm* — DLA Piper LLP US

(57) ABSTRACT

An impression cylinder (6) comprises a cylinder core (71) encompassing a bearing shaft (79), and a removable sleeve (63) that is slid onto the cylinder core (71). The cylinder core (71) has an electrical contact point in the form of a double-crimped metal ring (100) as well as a non-rotating brush (102) as a power supply. A conducting zone (631) of the slid-on sleeve (63) rests against the electrical contact point (100). The electrical contact point (100) and the power supply (102) are electrically insulated from the rest of the cylinder core (71) encompassing the bearing shaft (79) such that the rest of the cylinder core (71) is not charged during operation. The bearings (12) of the impression cylinder (6) therefore do not need to be electrically insulated with a lot of effort.

18 Claims, 8 Drawing Sheets

U.S. PATENT DOCUMENTS

Figure 1:
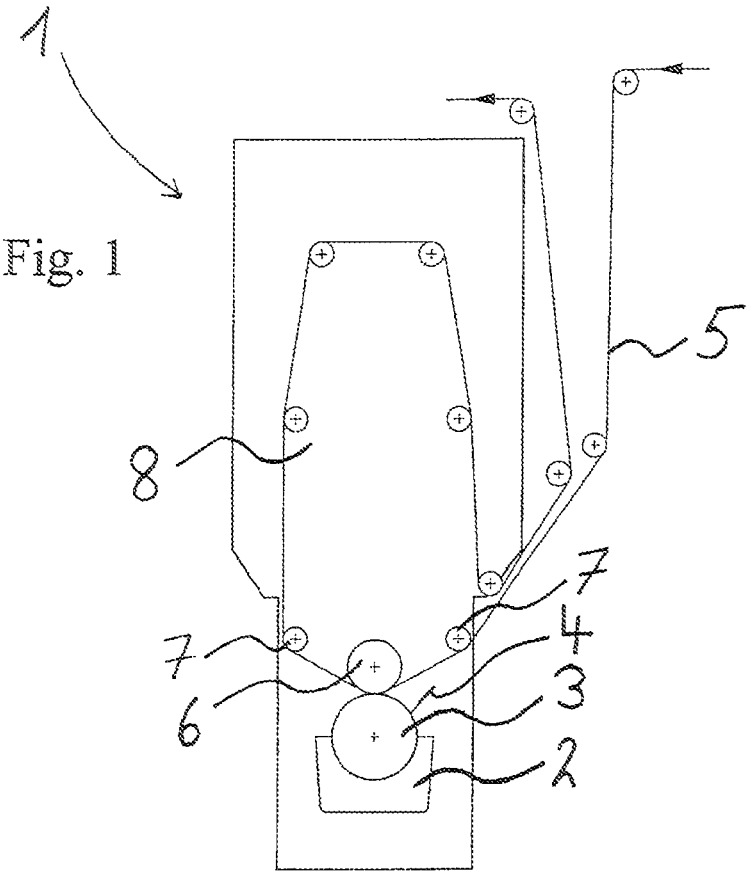

| | | | | |
|---|---|---|---|---|
| 5,178,071 | A | 1/1993 | Hyllberg | |
| 5,706,724 | A * | 1/1998 | Siler | 101/153 |
| 6,151,465 | A * | 11/2000 | Toba et al. | 399/90 |
| 6,377,772 | B1 * | 4/2002 | Chowdry et al. | 399/302 |
| 8,022,335 | B2 * | 9/2011 | Burton et al. | 219/216 |
| 2003/0066443 | A1 | 4/2003 | Doppler | |

OTHER PUBLICATIONS

English langauge abstract of DE 203 19 870, published May 4, 2005.
English langauge abstract of EP 1 477 310, published Nov. 17, 2004.

* cited by examiner

Fig. 16
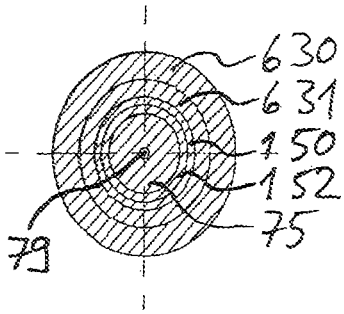
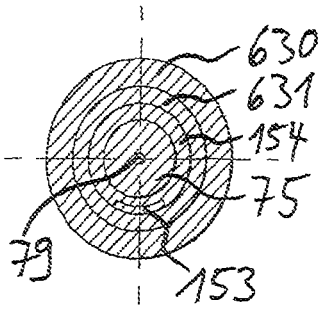
Fig. 17
Fig. 18
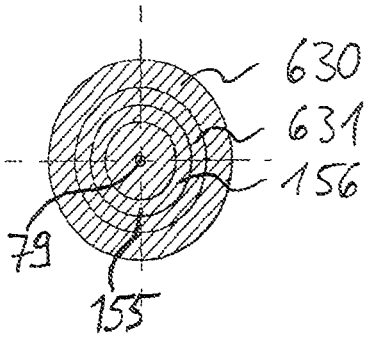
Fig. 19
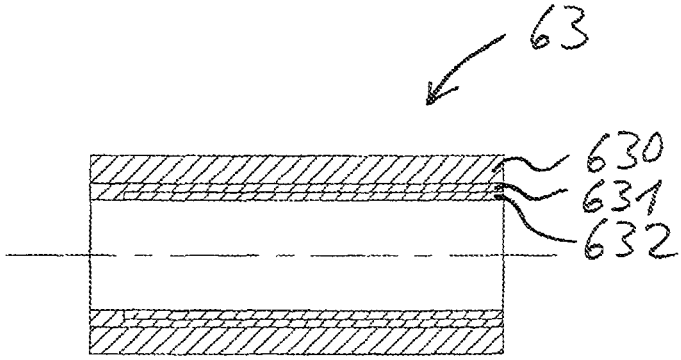

IMPRESSION ROLLER

The present invention relates to an impression roller, in particular for a rotogravure device, according to the preamble of independent patent claim 1.

Rotogravure devices are used for the production of a wide range of printed matter. They generally comprise among other things a gravure cylinder, an impression roller and additional rollers in order to transport printing substrate to be printed between the gravure cylinder and the impression roller, where the printing substrate is then printed in a so-called nip. Here, ink from an ink trough is applied to the gravure cylinder, the print pattern included on the gravure cylinder printed on to the printing substrate and subsequently the printing substrate dried in a dryer.

The use of an electrostatic printing aid, with which the outermost layer of the impression roller is electrostatically charged, brings about improved print quality. Here, the impression roller for example is produced with a semi-conductor layer as outermost layer and this semi-conductor layer is then charged in operation. The power feed can be effected in various manners.

Modern impression rollers are often constructed in multiple parts and comprise at least one roller core comprising a bearing shaft and a removable sleeve slid thereon. Such impression rollers have the advantage that by stocking sleeves of different lengths and through simple exchanging of the corresponding sleeves printed matter of different widths can be produced with the same rotogravure device without the entire impression roller having to be replaced in each case. The outer jacket of the impression roller is also a more wear-intensive part than the roller core so that through the separation into roller core, which mostly consists of steel, and removable sleeve the maintenance of the rotogravure device is simplified, lower costs are incurred and altogether more cost-effective printing is possible. As a rule, the sleeves comprise a plurality of layers which are applied to a plastic tube and are thus light compared with the roller core, which reduces transport expenditure.

However, disadvantageous with the known multi-part impression rollers with sleeves and electrostatic charging of the outermost layer of the sleeve is the fact that the sleeves are each charged via the roller core which for this purpose is itself charged. This results in that the impression rollers have to be mounted in the rotogravure device with complicated, insulating bearings in order to avoid that charge is discharged via the bearings. In addition, newer, more stringent explosion protection regulations can only be satisfied with difficulty with these conventional arrangements.

The present invention is therefore based on the object of creating an impression roller of the type mentioned at the outset which makes possible charging of the outermost layer of the sleeve without having to laboriously electrically insulate the bearings of the impression roller.

This object is solved through the impression roller according to the invention as it is defined in the independent patent claim 1. Advantageous embodiment versions are obtained from the dependent patent claims.

The nature of the invention consists in the following: An impression roller, in particular for a rotogravure device, comprises a roller core having a bearing shaft and a removable sleeve slid on to the roller core. The roller core comprises an electrical contact point and a power feed to this electrical contact point. A conductive or semi-conductive region of the slid-on sleeve contacts the electrical contact point. The electrical contact point and the power feed are electrically insulated from the rest of the roller core comprising the bearing shaft, so that the remainder of the roller core is not charged in operation.

With the impression roller according to the invention it is prevented with an electric insulation that the voltage intended for charging the outermost layer of the sleeve is also able to charge the roller core of the impression roller. Because of this, the bearings of the bearing shaft of the impression roller can be designed without complicated insulations and the more stringent regulations of explosion protection can be satisfied in a simpler manner. Preferentially the bearing shaft rotates along with the rest of the roller core, but an embodiment with a rigid bearing shaft, about which the rest of the impression roller rotates, is also possible.

Advantageously the sleeve comprises a highly conductive layer and a semi-conductive layer arranged on top of that. The semi-conductive layer is the outermost layer of the sleeve to be electrostatically charged, while the highly conductive layer is provided for the even charging of the semi-conductive layer. The semi-conductive layer for example consists of a doped plastic or a doped rubber mixture, while the highly conductive layer usually consists of metal, for example a metal tube, a wound metal wire or a metal foil, of carbon fibre-reinforced plastic (CRP) or a conductive rubber or polyurethane (PU). A sleeve without insulating layer can be directly slid on to the roller core if the outermost layer of the roller core is electrically insulating.

Preferentially however the sleeve comprises an electrically insulating layer, a highly conductive layer arranged on top of that and a semi-conductive layer arranged on top of that. The highly conductive layer again is responsible for the even charging of the semi-conductive layer while the innermost electrically insulating layer insulates the sleeve towards the roller core. The electrically insulating layer can for example be designed as carrier tube of the sleeve preferentially manufactured of plastic.

Advantageously the highly conductive layer of the slid-on sleeve directly contacts the electrical contact point or is connected with the latter via a highly conductive connection. In this manner, the contact point can optimally charge the highly conductive layer.

Preferentially the electrical contact point is embedded in an insulator block. The insulator block guarantees efficient electrical insulation from the remainder of the roller core.

With an advantageous embodiment version the roller core comprises an electrically insulating outermost layer except for the electrical contact point. This makes possible using a sleeve without electrically insulating layer.

With an advantageous embodiment version the electrical contact point comprises a protruding, elastically yielding contact element, preferentially a contact fin, a ball pressure element or bristles. Because of this, good contact to the slid-on sleeve and good current transmission is ensured in a simple manner.

With an alternative advantageous embodiment version the electrical contact point comprises a corona electrode. The corona electrode makes possible contactless charge transmission and requires less maintenance than contacting contact elements.

Preferentially the electrical contact point is designed in ring shape over the entire circumference of the impression roller. This ensures rapid and even charging of the semi-conductive layer of the sleeve.

With an alternative embodiment version the electrical contact point is designed by way of a ring segment of the circumference of the impression roller in the region of 0° to 90°, preferentially 0° to 60°, even more preferred 0° to 30°. The electrical contact point with this embodiment version is less complicated than with the embodiment version where it extends ring-shaped over the entire circumference of the impression roller.

Preferentially the electrical contact point is arranged on a face end of the roller core. On the one hand this facilitates the power feed and on the other hand the face end is often better accessible than a middle region of the roller core, so that the electrical contact point can be realised in a simpler manner. However, an arrangement of the electrical contact point in a middle region of the roller core is also possible.

With an advantageous embodiment version the power feed comprises an electric line which is routed through the roller core, preferentially also through the bearing shaft, and an additional electrical contact point which is arranged on a face end of the roller core. The current transmission from the resting part of the power feed to the part co-rotating with the roller core can thus be optimally positioned independent of the electrical contact point which the sleeve contacts.

Preferentially the power feed comprises a brush, a contact roller, a corona electrode or an induction device. These are reliable and simple means in order to supply the electrical contact point with the power required for the charging of the outermost layer of the sleeve.

Figure 2:
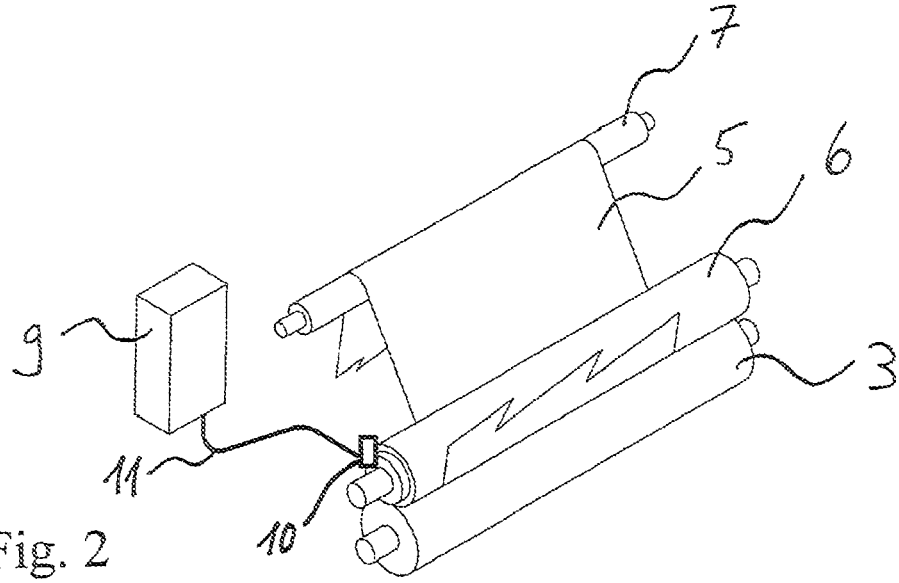
Figure 3:
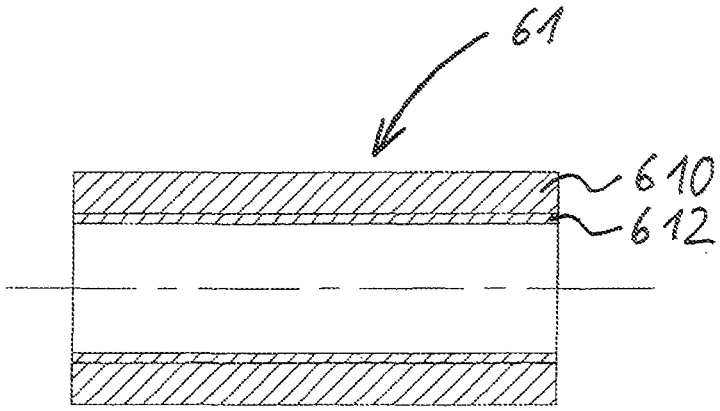
Figure 4:
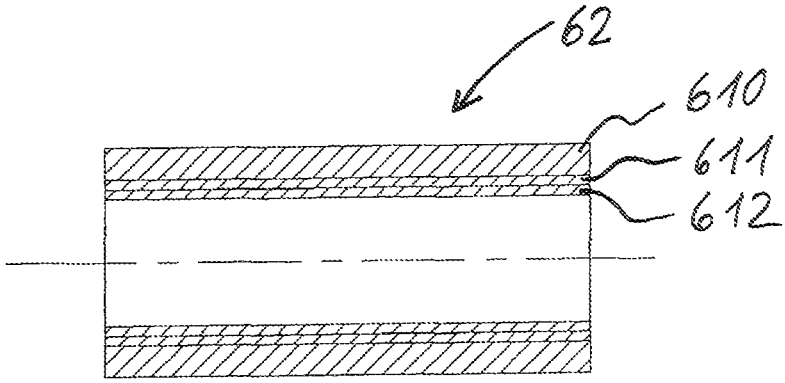
Figure 5:
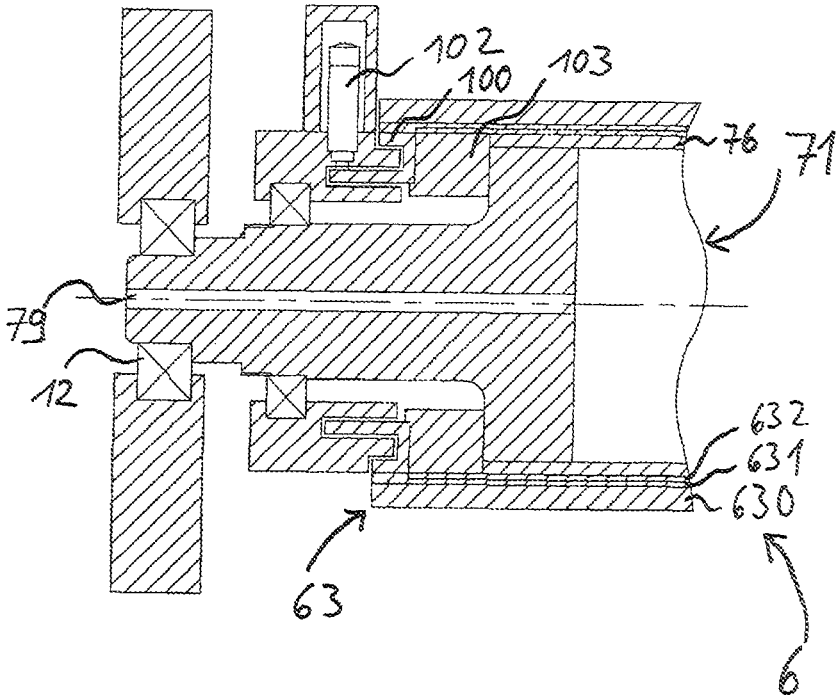
Figure 6:
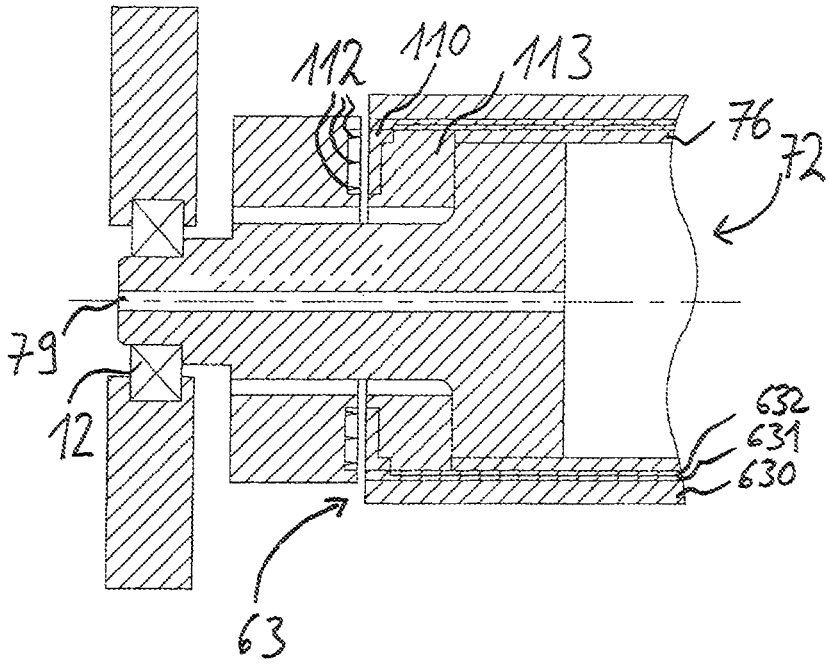
Figure 7:
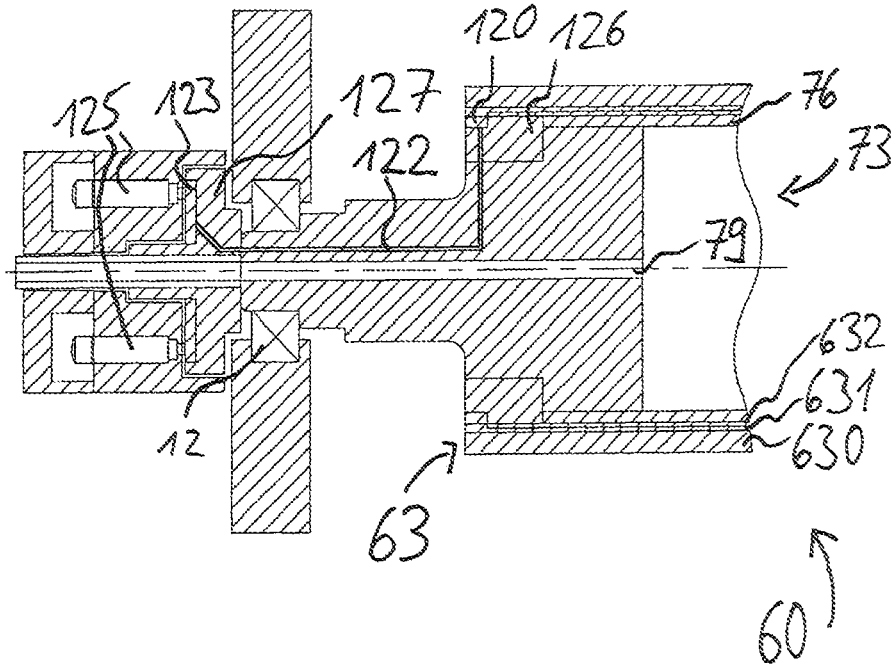
Figure 8:
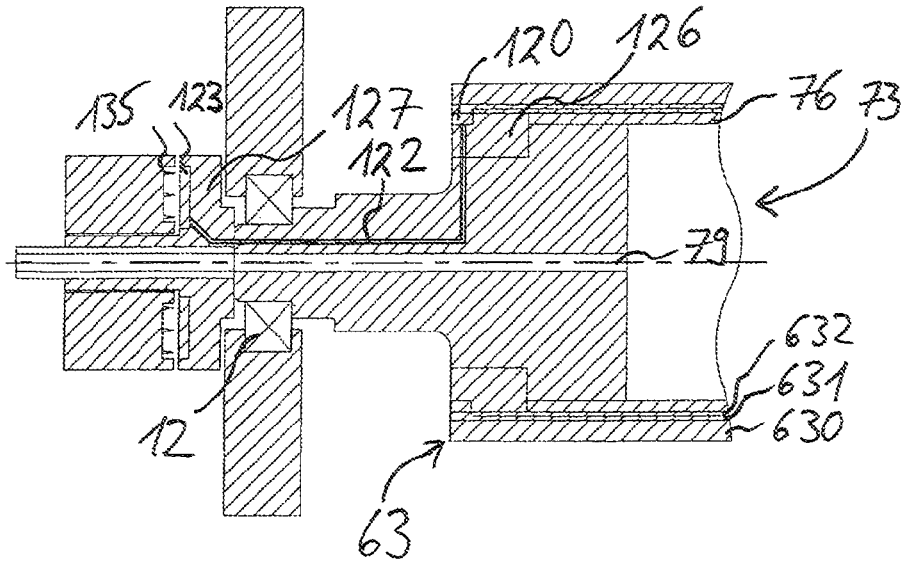
Figure 9:
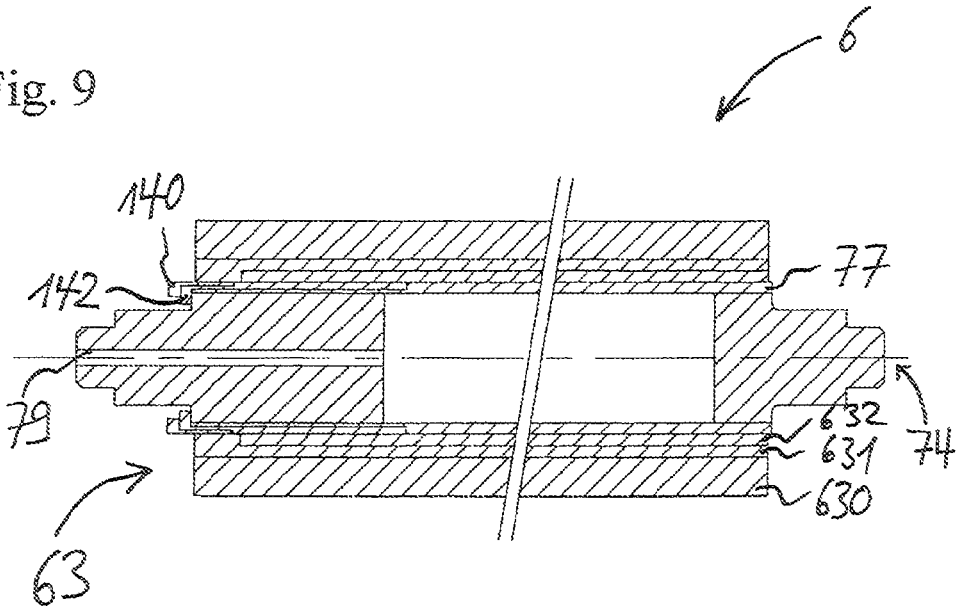
Figure 10:
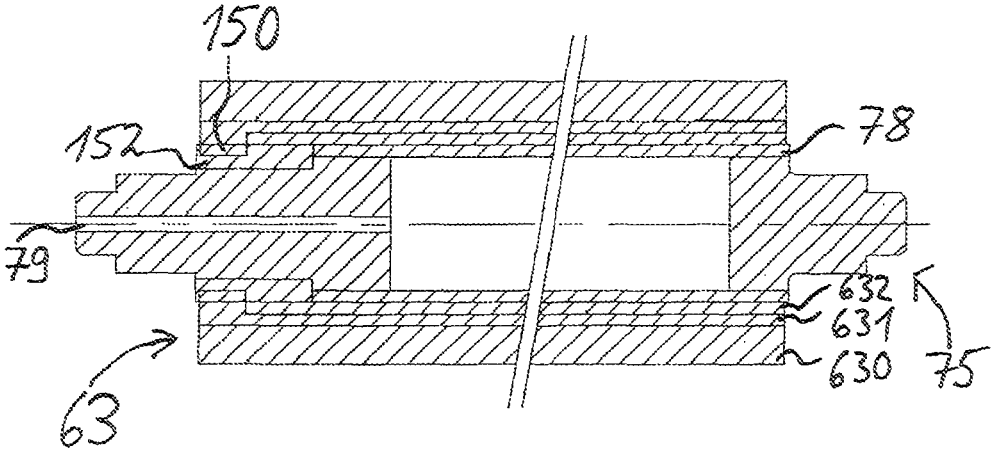
Figure 11:
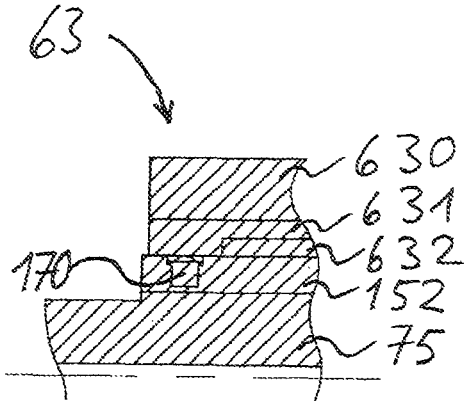
Figure 12:
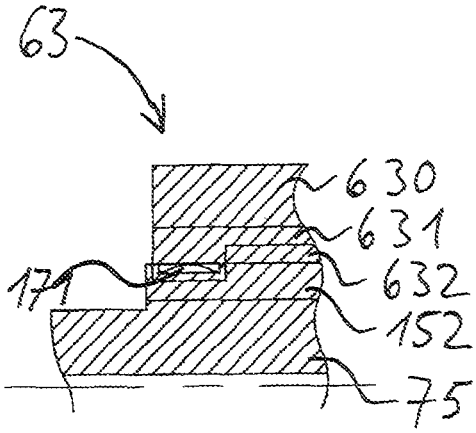
Figure 13:
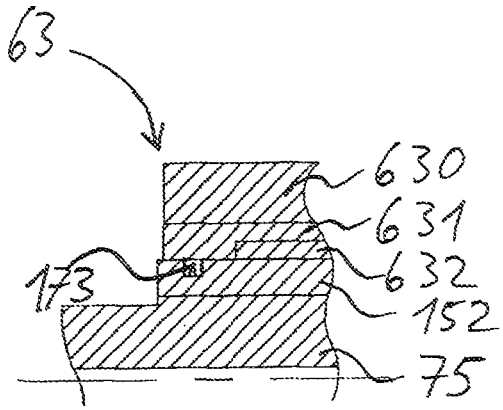
Figure 14:
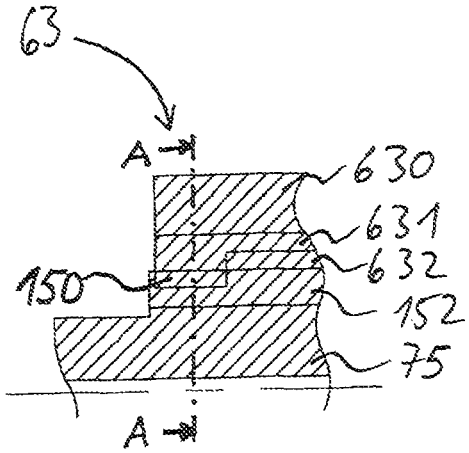
Figure 15:
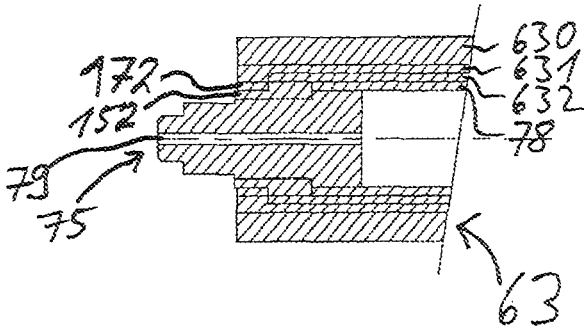
Figure 20:
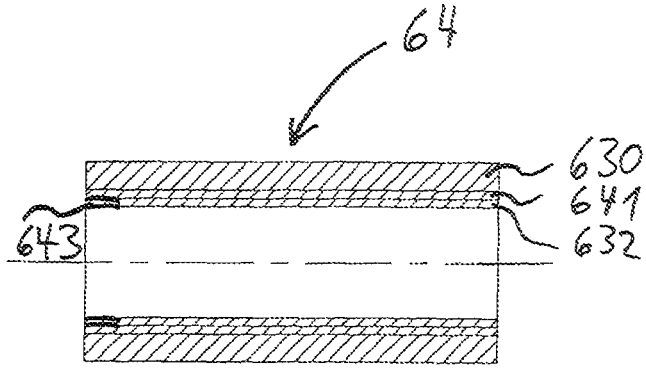
Figure 21:
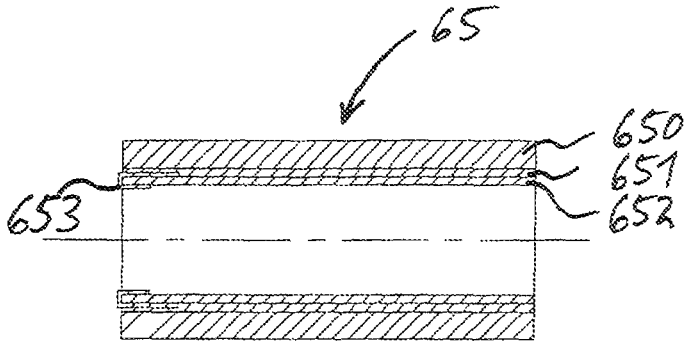
Figure 22:
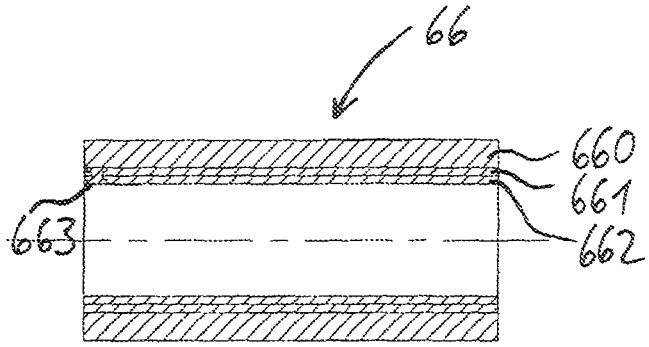
Figure 23:
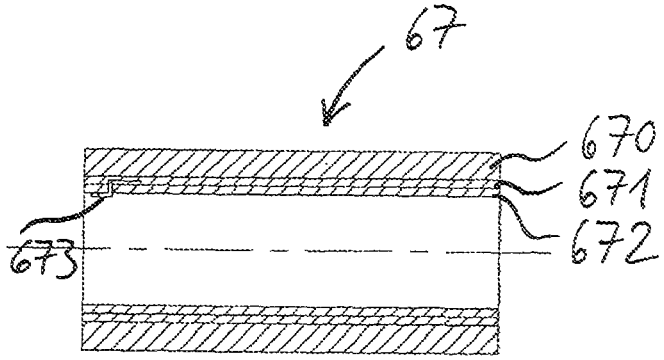

In the following, the impression roller according to the invention is described in more detail by means of exemplary embodiments making reference to the enclosed drawings. It shows:

FIG. 1—a schematic lateral view of an exemplary embodiment of a rotogravure device with an impression roller according to the invention;

FIG. 2—a perspective view of a part of the rotogravure device of FIG. 1 with a voltage supply;

FIG. 3—a longitudinal section through an exemplary embodiment of a two-layer sleeve of an impression roller according to the invention;

FIG. 4—a longitudinal section through an exemplary embodiment of a three-layer sleeve of an impression roller according to the invention;

FIG. 5—a longitudinal section through a part of a first exemplary embodiment of an impression roller according to the invention with a power feed comprising a brush;

FIG. 6—a longitudinal section through a part of a second exemplary embodiment of an impression roller according to the invention with a power feed comprising a corona electrode;

FIG. 7—a longitudinal section through a part of a third exemplary embodiment of an impression roller according to the invention with a power feed comprising two brushes and an electric line routed through the roller core;

FIG. 8—a longitudinal section through a part of a fourth exemplary embodiment of an impression roller according to the invention with a power feed comprising a corona electrode and an electric line routed through the roller core;

FIG. 9—a longitudinal section through a part of a fifth exemplary embodiment of an impression roller according to the invention with an electrical contact point protruding on the face end;

FIG. 10—a longitudinal section through a part of a sixth exemplary embodiment of an impression roller according to the invention with an electrical contact point embedded in an insulator block;

FIG. 11—a detail view of an impression roller according to the invention with an electrical contact point designed as ball pressure element according to a first exemplary embodiment;

FIG. 12—a detail view of an impression roller according to the invention with an electrical contact point formed through contact fins according to a second exemplary embodiment;

FIG. 13—a detail view of an impression roller according to the invention with an electrical contact point designed as corona electrode according to a third exemplary embodiment;

FIG. 14—a detail view of the impression roller of FIG. 10 with an electrical contact point designed as metal ring according to a fourth exemplary embodiment, which is embedded in an insulator block;

FIG. 15—a detail view of an impression roller according to the invention with an electrical contact point designed as metal ring according to a fifth exemplary embodiment, which is exposed on the face end;

FIG. 16—a cross-sectional view of the impression roller of FIG. 14 according to the line A-A in FIG. 14;

FIG. 17—a cross-sectional view of an alternative impression roller to the impression roller of FIG. 14;

FIG. 18—a cross-sectional view of a further impression roller alternative to the impression roller of FIG. 14;

FIG. 19—a longitudinal section through a first exemplary embodiment of a sleeve of an impression roller according to the invention with a highly conductive layer pulled to the inside on the face end;

FIG. 20—a longitudinal section through a second exemplary embodiment of a sleeve of an impression roller according to the invention with a conductive ring in a recessed region of an insulating layer located on the inside;

FIG. 21—a longitudinal section through a third exemplary embodiment of a sleeve of an impression roller according to the invention with a conductive carbon coating about a face end of the insulating layer located on the inside;

FIG. 22—a longitudinal section through a fourth exemplary embodiment of a sleeve of an impression roller according to the invention with a metal pin through a face end of the insulating layer located on the inside; and FIG. 23—a longitudinal section through a fifth exemplary embodiment of a sleeve of an impression roller according to the invention with a conductive-wire through a face end of the insulating layer located on the inside.

A rotogravure device 1 according to the exemplary embodiment schematically shown in FIG. 1 comprises a gravure cylinder 3 which dips into an ink trough 2. Upon rotation of the gravure cylinder 3 it takes up printing ink on its surface in the ink trough 2 which is wiped off by a doctor 4 so that ink merely remains in the gravure cups of the gravure cylinder. Above the gravure cylinder 3 is located an impression roller 6 which with respect to the gravure cylinder moves in the opposite direction. Between the gravure cylinder 3 and the impression roller 6 is located a nip through which a printing substrate 5 is guided. The printing substrate 5 routed via deflection rollers 7 is subsequently transported further into a dryer 8, where the previously applied ink is dried. Finally the printing substrate 5 leaves the rotogravure device 1 and is routed to further devices which are not shown.

The rotogravure device 1 comprises a drive and an operator side. On the drive side the necessary drives are arranged, wherein on the operator side each of the operations required by the operator for the operation and the maintenance of the rotogravure device 1 can be carried out.

The following determination applies to the entire further description. If for the purpose of graphic clarity reference signs are contained in a figure but not explained in the directly associated description text or the other way round, reference is made to their mention in preceding figure descriptions.

FIG. 2 shows a schematic detail of the rotogravure unit from FIG. 1. The printing substrate 5 is guided via the reversing roller 7 in the nip between the impression roller 6 and the gravure cylinder 3. To improve the print quality the outermost layer of the impression roller 6 is electrostatically charged by means of a charging unit 10, which is connected with a voltage supply 9 via a cable connection 11.

Here, the impression roller is designed in multiple parts and comprises a roller core and a sleeve slid on to the roller core from the operator side, wherein the roller core and the sleeve are preferentially slightly conical. The sleeve can be simply exchanged from the operator side which allows quick conversion to another print format.

FIG. 3 shows an embodiment version of a sleeve 61, comprising two layers: an outer semi-conductive layer 610 and an inner insulating layer 612. The semi-conducting layer 610 is preferentially produced from doped rubber or doped polyurethane (PU), while the insulating layer is preferentially produced of plastic, e.g. of glass fibre-reinforced plastic (GRP).

FIG. 4 shows an alternative embodiment version of a sleeve 62 which, in addition to the outer semi-conductive layer 610 and the inner insulating layer 612, comprises a middle highly-conductive layer 611. The highly conductive layer 611 ensures even charging of the semi-conductive layer 610 when it is itself charged. The highly conductive layer 611 is preferentially of metal, e.g. a metal tube, a wound metal wire or a metal foil, of carbon fibre-reinforced plastic (CRP) or of conductive rubber or polyurethane (PU).

With the sleeves 61 and 62 shown in FIGS. 3 and 4 respectively the connection of the highly conductive layer 611 or the semi-conductive layer 610 with an electrical contact point on the roller core through or passed the insulating layer 612 is not shown. In this respect, reference is particularly made to FIGS. 19 to 23 and the corresponding description.

FIG. 5 shows a longitudinal section through a part of a first exemplary embodiment of an impression roller 6 according to the invention with a roller core 71, having a bearing shaft 79 and a carrier tube 79, and a sleeve 63 slid thereon, which comprises an inner insulating layer 632, a middle highly-conductive layer 631 and an outer semi-conductive layer 630. The impression roller 6 is rotatably mounted in a bearing 12. The highly conductive layer 631 is pulled to the inside at a face end of the impression roller 6 where it contacts an electrical contact point in form of a double offset metal ring 100. The metal ring 100 is attached to the remainder of the roller core 71 and electrically insulated from the latter via a ring-shaped insulator block 103. A power feed to the metal ring 100 comprises a non-rotating brush 102 which contacts the rotating double offset metal ring 100.

As alternative to the double offset metal ring 100 a metal piece can also be used which extends only over a part of the circumference of the roller core 71. In this case the non-rotating brush has to extend ring-shaped about the roller core 71.

FIG. 6 shows a longitudinal section through a part of a second exemplary embodiment of an impression roller according to the invention with a roller core 72, which again comprises the bearing shaft 79 and the carrier tube 76, and the sleeve 63 slid thereon, which comprises the inner insulating layer 632, the middle highly conductive layer 631 and the outer semi-conductive layer 630.

In contrast with the first exemplary embodiment the highly conductive layer 631 pulled to the inside at one face end of the impression roller 6 contacts an electrical contact point in form of a single offset metal ring 110. The metal ring 110 is attached to the remainder of the roller core 72 via a ring-shaped insulator block 113 and electrically insulated from said roller core. A power feed to the metal ring 110 comprises a non-rotating ring-shaped corona electrode 112 with a multiplicity of evenly distributed electrode guns which are directed towards the metal ring 110.

As alternative to the offset metal ring 110 a metal piece can also be used which extends only over a part of the circumference of the roller core 72.

FIG. 7 shows a longitudinal section through a part of a third exemplary embodiment of an impression roller 60 according to the invention with a roller core 73, which again comprises the bearing shaft 79 and the carrier tube 76, and the sleeve 63 slid thereon, which comprises the inner insulating layer 632, the middle highly conductive layer 631 and the outer semi-conductive layer 630.

In contrast with the first two exemplary embodiments the highly conductive layer 631 pulled to the inside at a face end of the impression roller 60 contacts an electrical contact point in form of a single metal ring 120. The metal ring 120 is attached to the remainder of the roller core 73 via a ring-shaped insulator block 126 and electrically insulated from said roller core. A power feed to the metal ring 120 comprises an insulated electric line 122 connected with said metal ring, which leads through the roller core 73 and its bearing shaft 79 to a face end of the bearing shaft 79 where it is connected with a further electrical contact point in form of a metal ring 123 in a ring-shaped insulator block 127. The metal ring 123 co-rotating with the bearing shaft 79 can be charged with two non-rotating brushes 125.

As alternative to the metal rings 120 and 123 metal pieces can also be used each of which extends only over a part of the circumference of the roller core 73. Accordingly, the insulator blocks 126 and 127 then only have to extend over a part of the circumference. Because of this, a ring-shaped brush has to be present in place of the two non-rotating brushes 125.

The fourth exemplary embodiment of an impression roller according to the invention shown in FIG. 8 differs from the third exemplary embodiment in that the metal ring 123 is charged not with brushes but with the help of a non-rotating ring-shaped corona electrode 135. Otherwise the same applies as what was said with regard to the third exemplary embodiment.

FIG. 9 shows a longitudinal section through a part of a fifth exemplary embodiment of an impression roller according to the invention with a roller core 74 comprising the bearing shaft 79 and a carrier tube 77 and the sleeve 63 slid thereon, which comprises the inner insulating layer 632, the middle highly conductive layer 631 and the outer semi-conductive layer 630.

In contrast with the first two exemplary embodiments the highly conductive layer 631 pulled to the inside at a face end of the impression roller contacts an electrical contact point in form of an offset metal ring 140, which protrudes from the face end of the impression roller. The metal ring 140 is attached to and electrically insulated from the remainder of the roller core 74 via a ring-shaped insulator block 142.

As alternative to the offset metal ring 140 a metal piece can also be used which only extends over a part of the circumference of the roller core 74.

FIG. 10 shows a longitudinal section through a part of a sixth exemplary embodiment of an impression roller according to the invention with a roller core 75 which comprises the bearing shaft 79 and a carrier tube 78 and the sleeve 63 slid thereon, which comprises the inner insulating layer 632, the middle highly conductive layer 631 and the outer semi-conductive layer 630.

In contrast with the fifth exemplary embodiment the highly conductive layer 631 pulled to the inside at a face end of the impression roller contacts an electrical contact point in form of a metal ring 150 which is embedded in a ring-shaped insulator block 152 and attached to the remainder of the roller core 75 and electrically insulated from the remainder of the roller core 75 via said insulator block.

As alternative to the metal ring 150 a metal piece can also be used which only extends over a part of the circumference of the roller core 75.

The electrical contact points 100, 110, 120, 140 and 150 shown in FIGS. 5 to 10 can be arranged both on the drive side as well as on the operator side and/or also in a middle region of the impression roller.

With the part of an impression roller according to the invention shown in a detail view in FIG. 11 the electrical contact point is designed as ball pressure element 170 according to a first exemplary embodiment, which is arranged in a recess of the ring-shaped insulator block 152. The ball pressure element 170 comprises a ball or a plurality of balls which is/are elastically pressed to the outside through one or a plurality of springs. It can extend ring-shaped over the entire circumference of the roller core 75 or only over a part thereof.

With the part of an impression roller according to the invention shown in a detail view in FIG. 12 the electrical contact point is formed through contact fins 171 according to a second exemplary embodiment. The contact fins 171 can extend ring-shaped over the entire circumference of the roller core 75 or only over a part thereof.

With the part of an impression roller according to the invention shown in a detail view in FIG. 13 the electrical contact point is realised through a corona electrode 173 according to a third exemplary embodiment. The corona electrode 173 can extend ring-shaped over the entire circumference of the roller core 75 or only over a part thereof.

With the part of an impression roller according to the invention shown in a detail view in FIG. 14 the electrical contact point is formed through a metal piece 150 according to a fourth exemplary embodiment. The metal piece 150 can extend ring-shaped over the entire circumference of the roller core 75 or only over a part thereof.

With the part of an impression roller according to the invention shown in a detail view in FIG. 15 the electrical contact point is formed through a metal piece 172 according to a fifth exemplary embodiment, which is exposed on the face end, i.e. not insulated. The metal piece 172 can extend ring-shaped over the entire circumference of the roller core 75 or only over a part thereof.

FIG. 16 is a cross-sectional view of the impression roller from FIG. 14 according to the line A-A in FIG. 14. In this cross-sectional view it is clearly noticeable that the metal piece 150 shown extends ring-shaped over the entire circumference of the roller core 75.

FIG. 17 shows an embodiment version of the impression roller from FIG. 14, wherein a metal piece 153 forming the electrical contact point only extends over a part of the circumference of the roller core 75. The remainder of the circumference is taken up by an insulator block 154, which accordingly is larger than the insulator block 152 of the embodiment version shown in FIG. 16.

FIG. 18 shows a further embodiment version of the impression roller from FIG. 14, wherein a metal piece 155 forming the electrical contact point extends only over a very small part of the circumference of the roller core 75. The remainder of the circumference is taken up by an insulator block 156 which accordingly is larger still than the insulator block 154 of the embodiment version shown in FIG. 17.

FIG. 19 shows a longitudinal section through the sleeve 63 of the impression rollers shown in FIGS. 5 to 15. With this sleeve 63, which comprises an inner insulating layer 632, a middle highly conductive layer 631 and an outer semi-conductive layer 630, the highly conductive layer 631 at the face end is pulled to the inside and the insulating layer 632 not entirely run as far as the face end edge of the sleeve 63. The highly conductive layer 631 can thus directly contact the electrical contact point on the roller core at this point.

FIG. 20 shows a longitudinal section through a second exemplary embodiment of a sleeve 64, wherein the insulating layer 632 likewise is not run entirely up to the face end edge of the sleeve 64. Here, a highly conductive layer 641 arranged between the inner insulating layer 632 and the outer semi-conductive layer 630 however is not pulled to the inside at the face end in contrast with the highly conductive layer 631 shown in FIG. 19. In the recessed region thus obtained a conductive ring 643 is arranged which forms a highly conductive connection between the highly conductive layer 641 and the electrical contact point on the roller core. Preferentially the conductive ring 643 is produced of metal or of carbon fibre-reinforced plastic (CRP).

FIG. 21 shows a longitudinal section through a third exemplary embodiment of a sleeve 65 with an inner insulating layer 652, a middle highly conductive layer 651 and an outer semi-conductive layer 650. About a face end of the insulating layer 652 a conductive carbon layer 653 is run which forms a highly conductive connection between the highly conductive layer 651 and the electrical contact point on the roller core.

FIG. 22 shows a longitudinal section through a fourth exemplary embodiment of a sleeve 66 with an inner insulating layer 662, a middle highly conductive layer 661 and an outer semi-conductive layer 660. The insulating layer 662 is traversed by a metal pin 663 at a face end, which pin forms a highly conductive connection between the highly conductive layer 661 and the electrical contact point on the roller core.

FIG. 23 shows a longitudinal section through a fifth exemplary embodiment of a sleeve 67 with an inner insulating layer 672, a middle highly conductive layer 671 and an outer semi-conductive layer 670. The insulating layer 672 is traversed at a face end by a conductive wire 673 which forms a highly conductive connection between the highly conductive layer 671 and the electrical contact point on the roller core.

The sleeves 63, 64, 65, 66 and 67 shown in FIGS. 19 to 23 are interchangeable among themselves insofar as they can be slid on to the same roller core and have a connecting point to the electrical contact point on the roller core in the same location.

Further design versions can be realised in addition to the impression rollers described above.

The invention claimed is:

1. An impression roller comprising:

a roller core having a bearing shaft; and a removable sleeve having an inner wall, an outer wall, and a pair of end walls, slidably removable from the roller core;

wherein the roller core comprises an electrical contact point and a power feed to said electrical contact point, and a conductive or semi-conductive region of the inner wall of the sleeve electrically contacts the electrical contact point, and wherein the electrical contact point and the power feed are electrically insulated from a remainder of the roller core comprising the bearing shaft so that the remainder of the roller core is not charged in operation.

2. The impression roller according to claim 1, wherein the sleeve comprises a highly conductive layer and a semi-conductive layer arranged thereon.

3. The impression roller according to claim 2, wherein the sleeve comprises an electrically insulating layer, a highly conductive layer arranged over the electrically insulating layer, and a semi-conductive layer arranged over the highly conductive layer.

4. The impression roller according to claim 2, wherein the highly conductive layer of the slid-on sleeve directly contacts the electrical contact point.

5. The impression roller according to claim 1, further comprising an insulator block, wherein the electrical contact point is embedded in the insulator block.

6. The impression roller according to claim 1, wherein the roller core except for the electrical contact point comprises an electrically insulating outermost layer.

7. The impression roller according to claim 1, wherein the electrical contact point comprises a protruding elastically yielding contact element.

8. The impression roller according to claim 7, wherein the protruding elastically yielding contact element is a contact fin, a ball pressure element or bristles.

9. The impression roller according to claim 1, wherein the electrical contact point comprises a corona electrode.

10. The impression roller according to claim 1, wherein the electrical contact point is a ring-shaped portion extending around the entire circumference of the impression roller.

11. The impression roller according to claim 1, wherein the electrical contact point is a ring segment of the circumference of the impression roller in the range of 0° to 90°.

12. The impression roller according to claim 1, wherein the electrical contact point is a ring segment of the circumference of the impression roller in the range of 0° to 60°.

13. The impression roller according to claim 1, wherein the electrical contact point is a ring segment of the circumference of the impression roller in the range of 0° to 30°.

14. The impression roller according to claim 1, wherein the electrical contact point is arranged on a face end of the roller core.

15. The impression roller according to claim 1, wherein the power feed comprises an electric line which is routed through the roller core, and comprises a further electrical contact point which is arranged on a face end of the roller core.

16. The impression roller according to claim 15, wherein the electric line is also routed through the bearing shaft.

17. The impression roller according to claim 1, wherein the power feed comprises a brush, a contact roller, a corona electrode or an induction device.

18. The impression roller according to claim 2, further comprising a highly conductive connection through which the highly conductive layer of the slid-on sleeve is connected with the electrical contact point.

* * * * *